US006075315A

United States Patent [19]

Seko et al.

[11] Patent Number: 6,075,315

[45] **Date of Patent: *Jun. 13, 2000**

[54] FIELD-EMISSION COLD CATHODE HAVING IMPROVED INSULATING CHARACTERISTIC AND MANUFACTURING METHOD OF THE SAME

[75] Inventors: Nobuya Seko; Hironori Imura; Masayuki Yoshiki; Kunihiro Shiota, all of Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/618,378

[22] Filed: Mar. 19, 1996

[30] Foreign Application Priority Data

Mar. 20, 1995 [JP] Japan ..... 7-060886
Feb. 22, 1996 [JP] Japan ..... 8-034630

[51] Int. Cl.[7] ..... H01J 1/02; H01J 1/16; H01J 19/10; H01J 63/04

[52] U.S. Cl. ..... 313/336; 313/309; 313/351; 313/495

[58] Field of Search ..... 313/306–308, 313/309, 336, 346 R, 391, 495; 445/50, 51

[56] References Cited

U.S. PATENT DOCUMENTS 5,070,282 12/1991 Epsztein ..... 313/336 X
5,319,279 6/1994 Watanabe et al. ..... 313/309
5,394,006 2/1995 Liu .
5,534,743 7/1996 Jones et al. ..... 313/309

FOREIGN PATENT DOCUMENTS 03252029 11/1991 Japan .
04167326 6/1992 Japan .
0422337 9/1992 Japan .
04262337 9/1992 Japan .
04280037 10/1992 Japan .
06131970 5/1994 Japan .
07282718 10/1995 Japan .
WO 93/09558 5/1993 WIPO .
WO 96/08028 3/1996 WIPO .

OTHER PUBLICATIONS

C.A. Spindt, "A Thin–Film Field–Emission Cathode"; Journal of Applied Physics 39, pp. 3504–3505.
H.C. Miller, "Surface Flashover of Insulators"; IEEE Transactions on Electrical Insulation, vol. 24, No. 5, Oct. 1989, pp. 765–786.

*Primary Examiner*—Nimeshkumar D. Patel
*Assistant Examiner*—Mack Haynes
*Attorney, Agent, or Firm*—Whitham, Curtis & Whitham

[57] ABSTRACT

Piled-up films composed of different materials or composed of the same material manufactured by different methods or different conditions are used as an insulating layer for a field-emission cold cathode. The insulating layer may have a composition which is varied continuously in the thickness direction. A cross-section of the insulating layer may be made uneven. Preferably, a triple junction in which a substrate, the insulating layer, and a vacuum are in contact with one another, is disposed at a position which can not be seen from outside the device.

7 Claims, 23 Drawing Sheets

FIG. 7
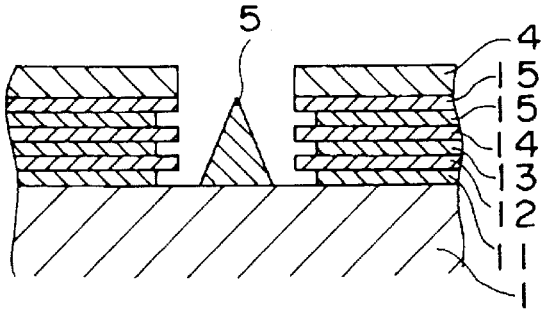
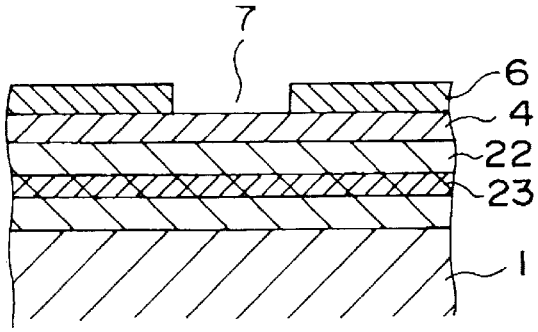
FIG. 8A
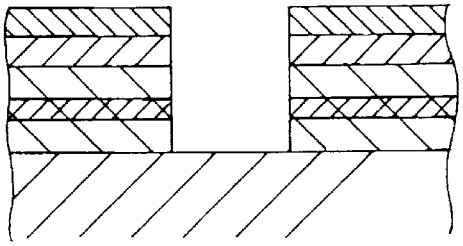
FIG. 8B
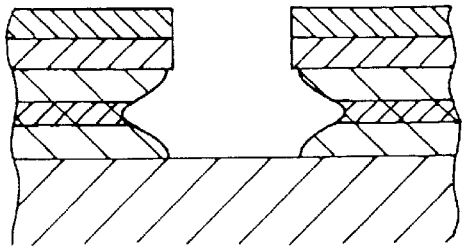
FIG. 8C (PRIOR ART)

(PRIOR ART)

(PRIOR ART)

FIELD-EMISSION COLD CATHODE HAVING IMPROVED INSULATING CHARACTERISTIC AND MANUFACTURING METHOD OF THE SAME

BACKGROUND OF THE INVENTION

1. Field of the Invention

The present invention relates to a field emission cold cathode and a manufacturing method of the same, more particularly to a structure of the field emission cathode having an improved insulating characteristic and a manufacturing method of the same.

2. Description of the Related Art

A field radiation cold cathode has been developed as an electron source which takes the place of a hot cathode utilizing a thermoelectric emission. The field-emission cold cathode generates a high electric field of more than 2 to $5\times10^7$ cm V/cm at the tip of its electrode having an acute protrusion to emit electrons into a space. Therefore, a device characteristic depends on a sharpness of the tip of the electrode, and it has been said that a radius of curvature of the tip of the electrode must be less than about several hundreds of angstroms. Furthermore, to generate the electric field, the electrodes have to be disposed at a short distance of about 1 $\mu$m or less from each other, and it has to be applied with a voltage of several hundreds of volts. As many as several thousands to several ten thousands of such elements, as described above, are practically formed on a single substrate, and they are often connected to each other in parallel so that they are used as arrays. Accordingly, the field-emission cold cathode is generally manufactured applying a fine processing technology.

One of the manufacturing methods of such a field-emission cold cathode is the one developed by Spindt et al. of SRI (Stanford Research Institute) and disclosed in Journal of Applied Physics 39, p. 3504, 1968. In this manufacturing method, an electrode having an acute protrusion in its tip can be obtained by depositing a refractory metal such as molybdenum on a conductive substrate. This manufacturing method is shown in FIGS. 20A to 20D. First of all, a silicon substrate 31 is prepared, and an oxide film is grown on the silicon substrate 31 to form an insulating layer 32. Subsequently, molybdenum is deposited as a gate layer 34 by means of a vacuum evaporation technique. Thereafter, a photoresist layer 36 having an opening 37 of the diameter about 1 $\mu$m is formed by means of photolithography technique (FIG. 20A). The gate layer 34 and the insulating layer 32 are etched using the photoresist layer 36 as a mask (FIG. 20B). After the photoresist layer 36 is removed, an aluminum sacrifice layer 38 is formed by performing a rotary slanting evaporation technique. Subsequently, molybdenum is evaporated onto the resultant structure from a vertical direction under vacuum, thereby forming an emitter electrode (FIG. 20C). Finally, the molybdenum film 30 deposited on the sacrifice layer 38 is lifted-off by selectively etching the sacrifice layer 38, thereby obtaining a device structure (FIG. 20D).

The element manufactured as described above is supplied with a voltage in such a manner that the emitter electrode 35 is biased negatively and the gate layer 34 is biased positively. Thus, electrons are emitted from the tip of the emitter electrode 35 in the direction perpendicular to the silicon substrate 31. Such structure is generally termed a vertical field-emission cold cathode.

Some structures of the vertical field-emission cold cathode, and manufacturing methods thereof, have been known in addition to the foregoing structures.

In Japanese Patent Application Laid Open Heisie 4-167326, a technology for manufacturing a field-emission cold cathode is disclosed in which an inner side surface 39 of an insulating layer 32 is made to be a tapered shape in cross-section (FIG. 21). Such a shape can be obtained by forming an untapered cavity in the insulating layer 32 with an anisotropic etching technique and then by lightly etching the side surface of the cavity formed in the insulating layer 32 using hydrofluoric acid of 1 to 10%. Thereafter, the device structure of the field-emission cold cathode can be obtained using the same processes shown in FIGS. 20A to 20D.

In Japanese Patent Application Laid Open Heisei 4-262337, a technology for manufacturing a field-emission cold cathode, in which a visor-shaped overhang is made utilizing an ion-implantation of boron, is disclosed as shown in FIGS. 22A to 22D. The summary of manufacturing processes of the field-emission cold cathode therein is as follows. An oxide film 42 is formed on a silicon substrate 41, and a polycrystalline silicon film 43 is formed on the oxide film 42 by means of a CVD technique. After boron ions are implanted into the entire surface of the polycrystalline silicon film 43, an opening portion 46 is formed by means of a photolithography technique and an etching technique (FIG. 22A). Subsequently, a thermal oxidation is conducted to form an oxide layer 45 (FIG. 22B). The oxide layer 45 is removed utilizing the difference between the etching rate of the oxide film 44 and that of the oxide layer 45, the oxide film 44 is doped with boron by the ion implantation. In addition, a photoresist is filled in the opening portion 46, and the surface of the oxide film 44 is flattened to form an opening portion 47 having a visor-shaped overhang (FIG. 22C). Subsequently, a metal is deposited by means of a vacuum evaporation technique to form simultaneously an emitter electrode 48 and a gate layer 40. Thus, a device structure of the field-emission cold cathode can be obtained (FIG. 22D).

Electrons emitted from the foregoing field-emission cold cathode disperse at a divergence angle of approximately 30°. Hence, as shown in FIG. 23, a field-emission cold cathode having the following multilayer-stacked structure has been disclosed. Specifically, an intermediate insulating layer 78 is further formed on a gate layer 74, and a control electrode layer 79 to suppress the divergence of the electron beam is formed on the intermediate insulating film 78. The summary of manufacturing processes will be described below. First, an insulating layer 72 made of an oxide film is grown on a silicon substrate 71, and a polycrystalline silicon film serving as a gate layer 74 is grown on the insulating layer 72. An oxide film serving as the intermediate insulating layer 78 is grown, and a polycrystalline silicon layer serving as the control electrode layer 79 is grown on the intermediate insulating layer 78 (FIG. 24A). Thereafter, a photoresist layer 76 is formed by a photoresist technique, and the control electrode layer 76 and the intermediate insulating layer 78 are etched anisotropically in this order whereby an opening portion 77 reaching to the surface of the gate layer 74 is formed (FIG. 24B). Subsequently, after removing the photoresist layer 76, an oxide layer is formed by the CVD technique, and then the oxide layer is subjected to an anisotropic etching performed vertically whereby the surface of the gate layer 74 is exposed. Hence, a side wall 80 is formed (FIG. 24C). Next, the gate layer 74 and the insulating layer 73 are subjected to an anisotropic etching in this order. Hence, a structure having diameters of the openings of the gate layer 74 and the control electrode layer 79 different from each other can be obtained (FIG. 24D).

Finally, after an emitter electrode is formed by means of the vacuum evaporation technique, the side wall 80 is selectively etched whereby the device structure shown in FIG. 23 can be obtained.

In the field-emission cold cathode, since a voltage more than several tens of volts is applied between the electrodes disposed at intervals of as little as about 1 $\mu$m as described above, an insulating characteristic between the electrodes of withstanding high voltage and having a low leakage current is one of the essential characteristics. Specifically, when the insulating element's ability to withstand voltage is low, the element is apt to be easily broken such that the field-emission cold cathode suffers a fatal damage. Moreover, when the leakage current is large, a quantity of power consumption increases and a stable operation of the element is disturbed.

Furthermore, since the field-emission cold cathode is used in the form of an array where a plurality of elements forming the device are arranged in an array fashion, if only one of the elements is broken for some reason and the broken element is short-circuited, the entire device fails to operate. Therefore, when some of the elements are broken, the broken element must be open-circuited and the break of the element must not affect other elements around the broken one.

In the section structure shown in FIG. 21 (Japanese Patent Application Laid-Open Heisei 4-167326) among the foregoing known section structures, the gate layer 34 has no overhang protruding from the insulating layer 32, and the whole of it is supported by the insulating layer 32. The section structure thereby processes a high strength. However, the section shape, i.e., the section shape of the opening surrounded by the side surface of the insulating layer 32, is tapered such that the opening is broader as it proceeds to the substrate 31. The electrons emitted-from the triple junction 39, in which the substrate 31, the insulating layer 32, and the space contact, are present continuously at an angle at which the wall of the insulating layer 32 crosses against a direction accelerated by an electric field. Therefore, there has been a problem that the insulating characteristic is deteriorated due to an electron collision against the surface of the insulating layer 32 and a secondary electron emission.

Furthermore, in the section structure shown in FIG. 22 (Japanese Patent Application Laid-Open Heisei 4-262337), the surface on which the emitter electrode 48 is formed is situated on a lower level than the surface of the substrate 41. Hence, a shape of the triple junction 49 at which the silicon substrate 41, the oxide film 42, and the space contact is almost circular concave. For this reason, an electric field is apt to be concentrated at this portion such that the insulating material's ability to withstand voltage is unfortunately reduced.

On the other hand, in the field-emission cold cathode which comprises the control electrode layer 79 as shown in FIG. 23, a voltage more than several tens of volts is applied between the gate layer 74 and the control electrode layer 70 and, therefore, the insulating characteristic between the gate layer 79 and the control electrode layer 79 is mentioned as one of the essential characteristics. Specifically, when the insulating breakdown voltage is low, the element is apt to be easily broken such that the field-emission cold cathode suffers a fatal damage. Moreover, when the leakage current is large, a quantity of power consumption increases and a stable operation of the element is disturbed.

SUMMARY OF THE INVENTION

An object of the present invention is to provide an element structure of a field-emission cold cathode which has an excellent insulating characteristic and which, when a part of one or of one of a plurality of the elements produces a dielectric breakdown, incurs no fatal damage to the functions of the remaining elements by minimizing an influence of that element's breakdown.

More particularly, when the field-emission cold cathode is placed in a vacuum, it is considered that a dielectric breakdown is principally produced by a surface discharge along a surface of the insulating layer. This insulating breakdown can be explained as follows (See IEEE Trans. Electr. Insl. Vol. 24, pp. 765–786, 1989):

Since an electric field is apt to concentrate at a triple junction located on a surface of a substrate, in which an insulating layer, the substrate, and a vacuum contact, electrons are emitted from this three-point contact. When these electrons collide with the surface of the insulating layer, secondary electrons are emitted from the surface of the insulating layer. At this time, an amplification phenomenon by which the secondary electrons, more than two per one incident electron, are emitted from the surface of the insulating layer, or another phenomenon by which gas emitted from the surface of the insulating layer is ionized leads to the dielectric breakdown.

A field-emission cold cathode of the present invention is characterized in that a stacked-layer aggregation, which is composed of films made of different materials or films made by different growth techniques or under different growth conditions, is used as an insulating layer. In the insulating layer, the composition may be formed to continuously change in a depth direction. Further, a cross-section of the insulating layer may be made uneven. Preferably, a triple junction at which the substrate, the above-described insulating layer, and the vacuum contact each other is disposed at a position which can not be seen from the outside. Further, in the field-emission cold cathode having a control electrode, a cross-section of the intermediate insulating layer is made uneven.

BRIEF DESCRIPTION OF THE DRAWINGS

For a comprehensive understanding of the present invention and the advantages thereof, reference is made to the following description taken in conjunction with accompanying drawings, in which:

FIG. 7 is a sectional view of the field-emission cold cathode according to the fourth embodiment of the present invention;

FIGS. 8A to 8C are sectional views showing manufacturing steps of the field-emission cold cathode according to the fifth embodiment of the present invention;

DETAILED DESCRIPTION OF THE PREFERRED EMBODIMENTS

Examples of the preferred embodiments will be described below with reference to the accompanying drawings.

Figure 1:
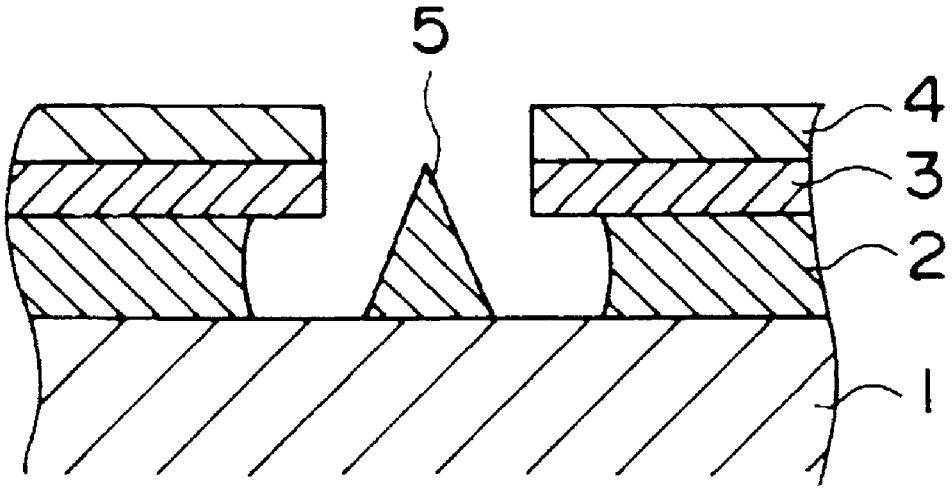
FIG. 1 is a sectional view of a field-emission cold cathode according to a first embodiment of the present invention.
Figure 2A:
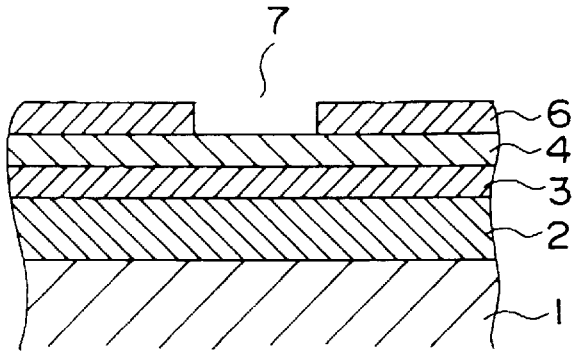
FIGS. 2A to 2D are sectional views showing manufacturing steps of the field-emission cold cathode according to the first embodiment of the present invention.
Figure 2B:
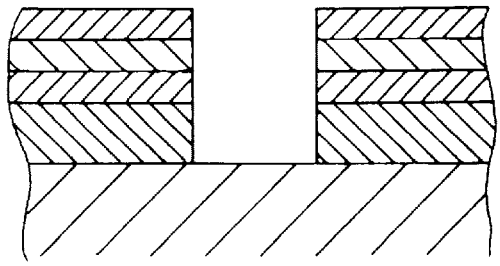
Figure 2C:
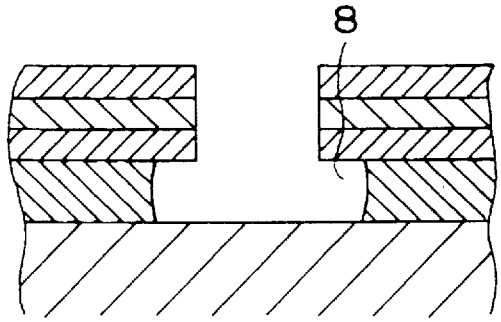
Figure 2D:
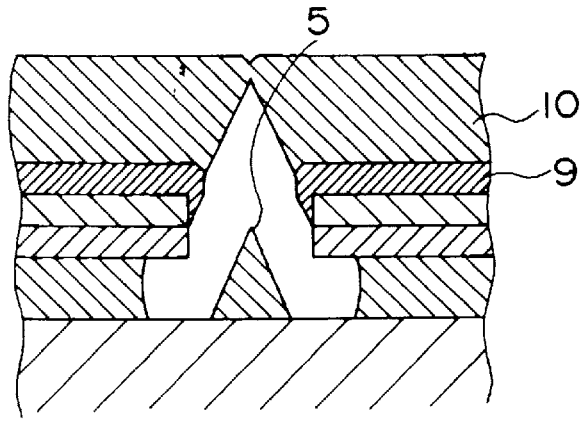

FIGS. 2A to 2D are sectional views showing schematically a first embodiment of a manufacturing method of a field-emission cold cathode according to the present invention. In the first embodiment, a thermal oxide film of about 0.6 $\mu$m thickness serving as a first insulating layer 2 is formed on a silicon substrate 1. Subsequently, a silicon nitride film of about 0.2 $\mu$m thickness serving as a second insulating layer 3 is formed on the thermal oxide film using a CVD (chemical vapor deposition) technique. Further, a molybdenum film of about 0.2 $\mu$m thickness serving as a gate layer 4 is formed on the silicon nitride film using a vacuum evaporation technique. Thereafter, a photoresist layer 6 having an opening 7 of a diameter about 1 $\mu$m is formed using a lithography technique (FIG. 2A). The gate layer 4, the second insulating layer 3, and the first insulating layer 2 are sequentially etched in this order using the photoresist layer 6 as a mask by an RIE (reactive ion etching) technique which uses carbon tetrafluoride and the like (FIG. 2B). Subsequently, the first insulating layer 2 is subjected to a wet etching using hydrofluoric acid so that step difference 8 is formed between the first and second insulating layers 2 and 3 (FIG. 2C). After removing the photoresist layer 6, a sacrifice layer 9 is formed by evaporating aluminum under vacuum from a diagonal direction while the silicon substrate 1 is rotating. Thereafter, an emitter electrode 5 is formed on the silicon substrate 1 by evaporating molybdenum under vacuum from a vertical direction (FIG. 2D). Finally, when the sacrifice layer 9 is etched using phosphoric acid and the molybdenum layer 10 is removed, the field-emission cold cathode is completed as shown in FIG. 1.

In this embodiment, the silicon substrate is used. A film aggregation which is made by forming a conductive thin film such as molybdenum and tungsten on an insulating substrate such as glass and ceramic may also be used as a substrate. In this embodiment the thermal oxide silicon layer and the CVD silicon nitride layer are used as a combination of the first and second insulating layers. However, it is a matter of course that other materials and other combinations of manufacturing methods can be employed when both layers have sufficient insulating properties and the first and second insulating layers are made such that the etching of the first insulating layer can be carried out in the presence of the second insulating layer. Furthermore, in this embodiment, the first insulating layer 2 is etched by means of the RIE technique. However, the same effect can be obtained when the gate layer 4 and the second insulating layer 3 are etched by means of the RIE technique and subsequently the first insulating layer 2 is etched using hydrofluoric acid.

Figure 25:
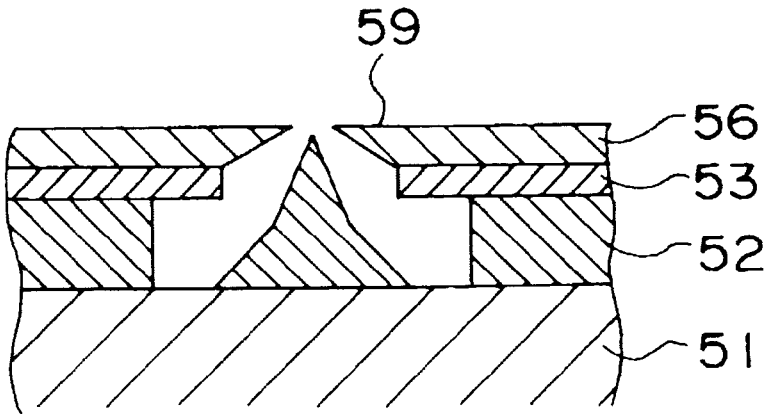
FIG. 25 (PRIOR ART)
FIG. 25 is a sectional view of another conventional field-emission cold cathode.

In Japanese Patent Application Laid Open Heisei 6-131970, a field-emission cold cathode is disclosed having a section structure similar to that of this embodiment, wherein an oxide film 52 and a nitride film 53 are stacked on an insulating film 51 as shown in FIG. 25, and a step difference is made between the oxide film 52 and the nitride film 53. However, when the section structures in FIG. 25 and this embodiment are compared, it is seen that in the section structure in FIG. 25 the gate electrode 56 protrudes greatly at its top portion, i.e., a gate protrusion portion 59 from the nitride film 53 and moreover is made thin. Therefore, a mechanical strength of the gate protrusion portion 59 is decreased. Furthermore, when the gate protrusion portion 59 is subjected to an ion bombardment while using the device, the damage of the gate protrusion portion 59 is severe. A fatal breakdown of the whole device is therefore apt to occur. Furthermore, pertaining to elements belonging to the same gate series being used as arrays, a relevant factor is that an area occupied by a single emitter is large. Therefore, the section structure shown in FIG. 25 is not suitable when an element integration level is required to be high and a current density is likewise increased. The section structure of this embodiment of the present invention, however, differs from the conventional section structure in FIG. 25 such that the section structure of this embodiment can solve advantageously all of the above-identified problems.

In this embodiment, an opening diameter Dg of the gate layer 4 and the opening diameter Di of the second insulating layer 3 nearest to the gate layer 4 are the same. However, it is possible to make the size relationship between both opening diameters Dg and Di as Dg>Di or Dg<Di by setting the RIE conditions.

Next, a foundation for the size relationship between both opening diameters Dg and Di of the gate layer 4 and the second insulating layer 3 being restricted to −Dg/2<Dg−Di<Dg/3 will be described.

In a step of forming the emitter electrode 5 by the vacuum evaporation of molybdenum, a top angle of the emitter electrode 5 is always 40° to 46° degrees depending on the evaporation conditions. Therefore the size of the emitter electrode 5 is determined as a decreasing quantity of the diameter of the opening portion which, in turn, is directly determined from the diameter of the opening portion for forming the emitter electrode 5 and the formation conditions of the sacrifice layer 9. The following description is made in accordance with the dimensions shown in this embodiment. However, if the dimension ratio is not changed in spite of the change of the opening portion diameter, its interrelationship between the gate layer 4 and the emitter electrode 5 is not changed.

When the diameter Di of the opening portion of the second insulating layer 3 is larger than the diameter Dg of the opening portion of the gate layer 4 (FIG. 2B), a section structure is obtained wherein the gate layer 4 protrudes when viewed from the emitter electrode 5. Therefore, in order to obtain the size of the emitter electrode 5 described in this embodiment the diameter of the opening portion Dg of the gate layer 4 must be 1 μm. Furthermore, when the insulating breakdown-resistance of the field-emission cold cathode of the present invention is considered, the diameter Di of the opening portion of the second insulating layer 3 should be equal to the diameter Dg of the opening portion of the gate layer 4. However, the second insulating layer 3 is sometimes etched to some degree, depending on the etching conditions for the sacrifice layer. Furthermore, when a processing dimension near a processing dimension safety margin in an exposure machine such as a stepper scale-down exposure machine, a ratio of a diameter of an opening to a distance between openings adjacent to each other is 2:1. Specifically, when the minimum processing dimension is 1 μm, the diameter of the opening is 1 μm and a circumference pitch of the openings is 1.5 μm (the minimum dimension of adjacent openings on the gate layer 4 is 0.5 μm). Therefore, the diameter Di of the opening portion of the second insulating layer 3 must be 1.5 μm or less so that the size relationship between the diameter Dg of the opening portion of the gate layer 4 and the diameter Di of the opening portion of the second insulating layer 3 is restricted to −Dg/2<Dg−Di.

Figure 3A:
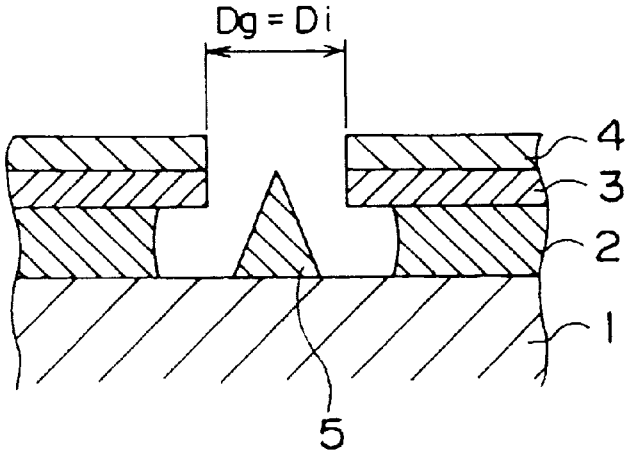
FIGS. 3A to 3C are sectional views showing the relation between the opening diameters of a gate layer and an insulating layer of the field-emission cold cathode according to the first embodiment of the present invention.
Figure 3B:
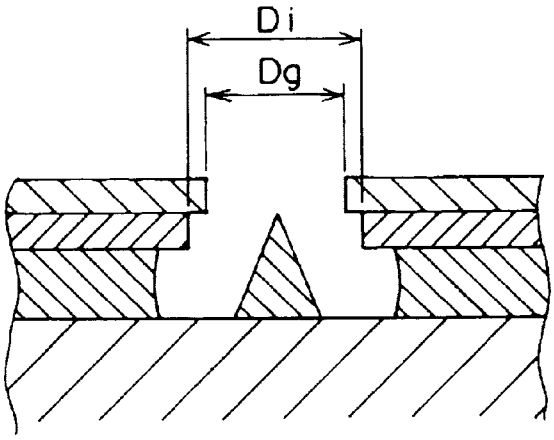
Figure 3C:
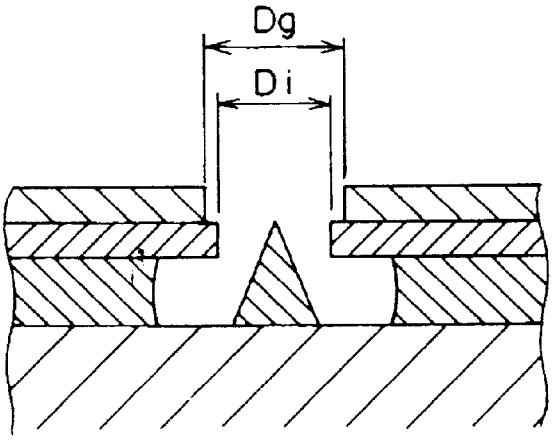

When the diameter Di of the opening portion of the second insulating layer 3 is smaller than the diameter Dg of the opening portion of the gate layer 4 (FIG. 3C), the insulating layer protrudes when viewing from the emitter electrode 5. Therefore, in order to obtain the size of the emitter electrode 5 described in this embodiment, the diameter Di of the opening portion of the second insulating layer 3 must be 1 μm. In addition, when it is assumed that the size relationship between the diameter Dg of the opening portion of the gate layer 4 and the diameter Di of the opening portion of the second insulating layer 3 is Dg−Di=Dg/3, the diameter Dg of the opening portion of the gate layer 4 is 1.5 μm. Making the diameter Dg of the opening portion of the gate layer 4 larger without changing the shape of the emitter electrode weakens the electric field generated at the tip end of the emitter electrode 5 and deteriorates the emission characteristic. According to experiments of the inventors of the present invention, when the diameter Dg of the opening portion of the gate layer 4 is made to be 1.5 μm, an application voltage to the gate layer 4 at which emissions begin increases by about 20 V compared to the case where the diameter Dg is 1.0 μm. Furthermore, the increase in the emission amount in relation to the increase in the application voltage to the gate layer 4 becomes smaller. Therefore, when the field-emission cold cathode is put into a practical use as an electron source, the size relationship between the diameter Dg of the opening portion of the gate layer 4 and the diameter Di of the opening portion of the second insulating layer 3 must be Dg−Di<Dg/3.

Figure 4A:
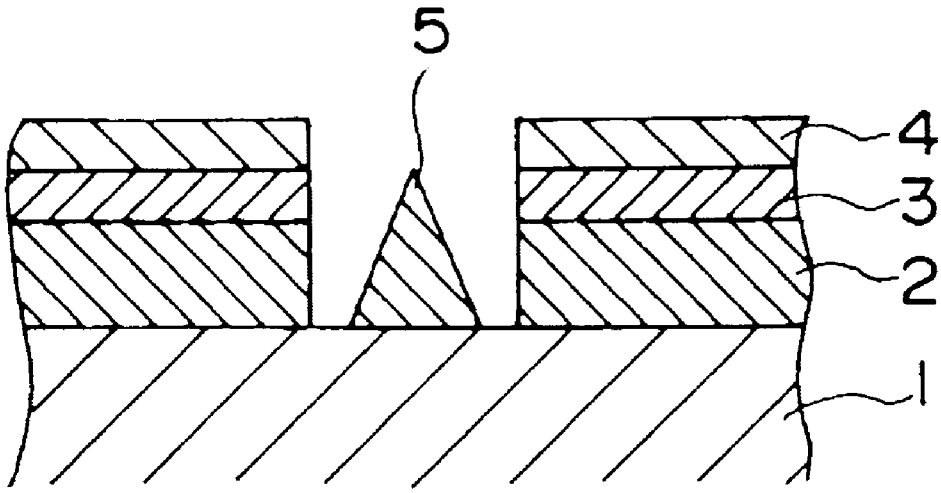
FIGS. 4A to 4B are sectional views showing manufacturing steps of a field-emission cold cathode according to a second embodiment of the present invention.
Figure 4B:
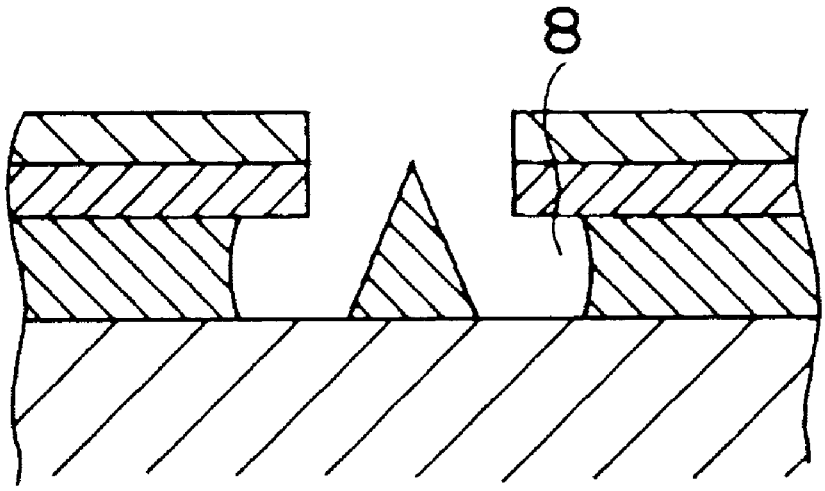

FIGS. 4A and 4B are sectional views schematically showing a second embodiment of the present invention. In FIGS. 4A and 4B, manufacturing steps for forming a step difference in the insulating layer are shown. Other manufacturing steps are the same as those of the first embodiment. In the second embodiment, after removing the gate layer 4 and the first and second insulating layer 2 and 3 using a photoresist layer (not shown in FIG. 4A) as a mask, a sacrifice layer (not shown) and the emitter electrode 5 are formed. Then the sacrifice layer is etched off. Thereafter, the first insulating layer 2 is further etched using hydrofluoric acid so that the step difference 8 is formed (FIG. 4B). According to this embodiment, when the emitter electrode 5 is formed by means of a vacuum evaporation technique, molybdenum deposited on an inner wall surface of the first insulating layer 2 can be removed. By using a material other than molybdenum for the emitter electrode 5 which is not etched by hydrofluoric acid, such as tungsten, nickel, palladium, platinum, gold, and silicon, the emitter electrode 5 is not etched at the formation of the step difference 8. Furthermore, by altering the material for the first insulating layer 2 to other materials, it is a matter of course that the effect can be obtained.

Figure 5A:
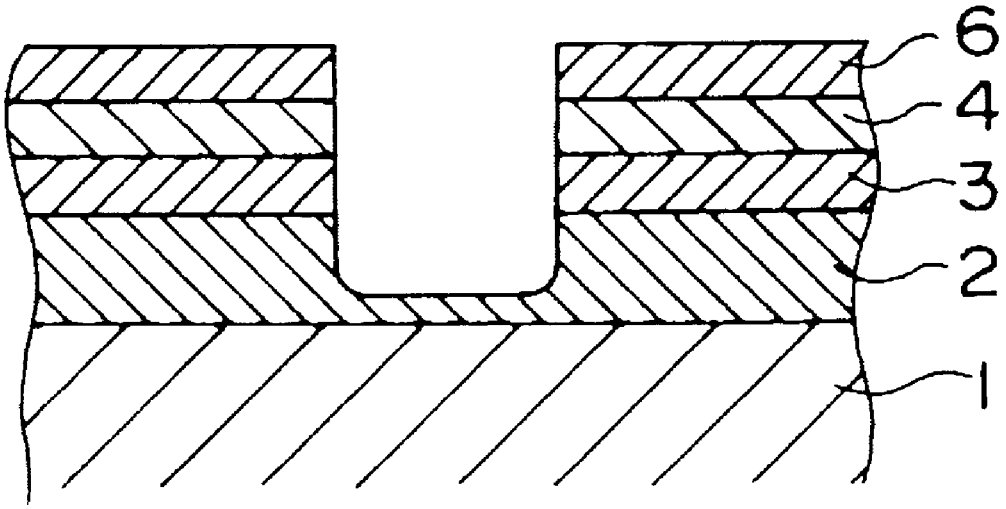
FIGS. 5A to 5B are sectional views showing manufacturing steps of a field-emission cold cathode according to a third embodiment of the present invention.
Figure 5B:
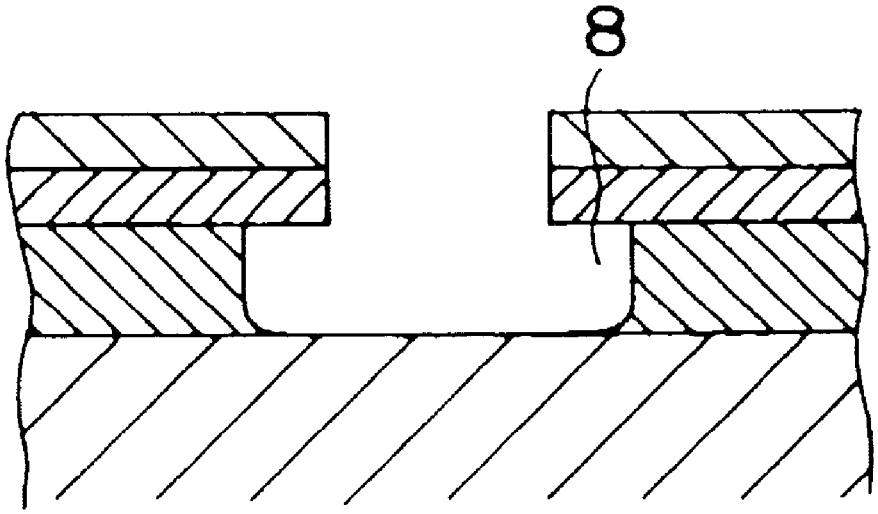

FIGS. 5A and 5B are sectional views schematically showing a third embodiment of the present invention. In FIGS. 5A and 5B, steps for forming a step difference in the insulating layer are depicted. Other steps depicted in FIGS. 5A and 5B are carried out in the same manner as that of the first embodiment. In the third embodiment, an etching of the first insulating layer 2 by means of an RIE technique is stopped before the completion of the etching of the first insulating layer 2 (FIG. 5A). Subsequently, the first insulating layer 2 is etched using hydrofluoric acid so that the silicon substrate 1 is exposed and the step difference 8 is formed (FIG. 5B). According to the third embodiment, an over-etching of the silicon substrate 1 when the first insulating layer 2 is etched by means of the RIE technique can be prevented perfectly. Hence, any protrusion on the silicon substrate 1 is not left on the silicon substrate. Furthermore, there is a benefit that a margin from the process point of view can be widened.

Figure 6A:
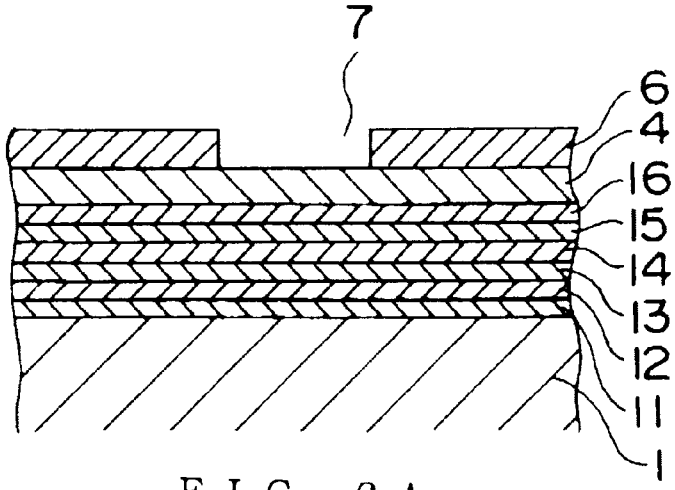
FIGS. 6A to 6B are sectional views showing manufacturing steps of a field-emission cold cathode according to a fourth embodiment of the present invention.
Figure 6B:
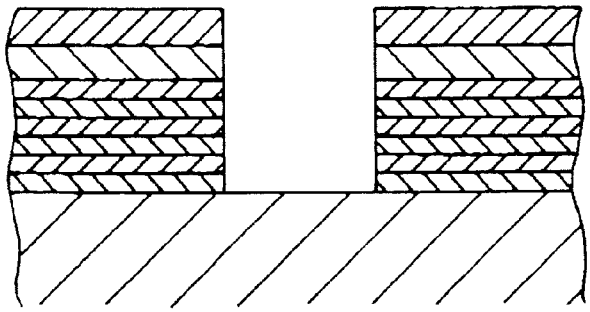
Figure 6C:
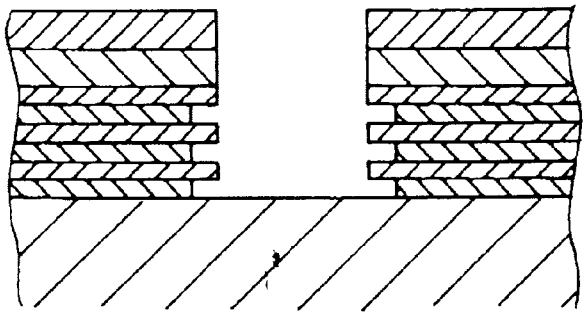

FIGS. 6A to 6C are sectional views schematically showing a fourth embodiment of the present invention. In FIGS.

6A and 6B, manufacturing steps for forming an insulating layer and a step difference are mainly described. Other manufacturing steps are the same as those of the first embodiment. In this embodiment, a silicon oxide film of about 0.13 μm thickness is formed on a silicon substrate 1 as the first insulating layer 11. Subsequently, a silicon nitride film of about 0.13 μm thickness is formed as the second insulating layer 12 on the first insulating layer 11. Further, silicon oxide films and silicon nitride films are formed as third to sixth insulating layers 13 to 16 on the second insulating layer 12. A molybdenum layer of about 0.2 μm thickness is formed as a gate layer 4 thereon. Thereafter, a photoresist layer 6 having an opening 7 of the diameter about 1 μm is formed by a photolithography technique (FIG. 6A). The gate layer 4 and the sixth to first insulating layer 16 to 11 are etched by an RIE technique using carbon tetrafluoride (FIG. 6B). Subsequently, the first insulating layer 11, the third insulating layer 13, and the fifth insulating layer 15 are subjected to a dry-etching using hydrofluoric acid so that unevenesses in the diameters (not numbered) of openings (not numbered) through the layers 11, 12, 13, 14, and 15 as shown in FIG. 6C are formed. Thereafter, an emitter electrode 5 is formed in the same manner as those of the first embodiment. Thus, the field-emission cold cathode as shown in FIG. 7 is completed.

In this embodiment, when the etching of the first insulating layer 11 is etched by more than 0.153 μm in a horizontal direction, the three-point contact is disposed at the position which can not be viewed from the outside of the gate. Therefore, when splashes from the adjacent broken element invade, they are not substantially attached to the triple junction.

Also in this embodiment, in the same manner as the second embodiment, it is possible to adopt the way that the unevenesses are formed by etching the silicon oxide layer after the formation of a cone-shaped emitter electrode. Furthermore, as in the third embodiment, it is also possible to adopt the way in which the etching of the first insulating layer 11 using the RIE technique is stopped before the completion of the etching of the first insulating layer, subsequently the surface of the silicon substrate 1 is exposed by the wet etching using hydrofluoric acid, and at the same time the unevenesses are formed.

Figure 26:
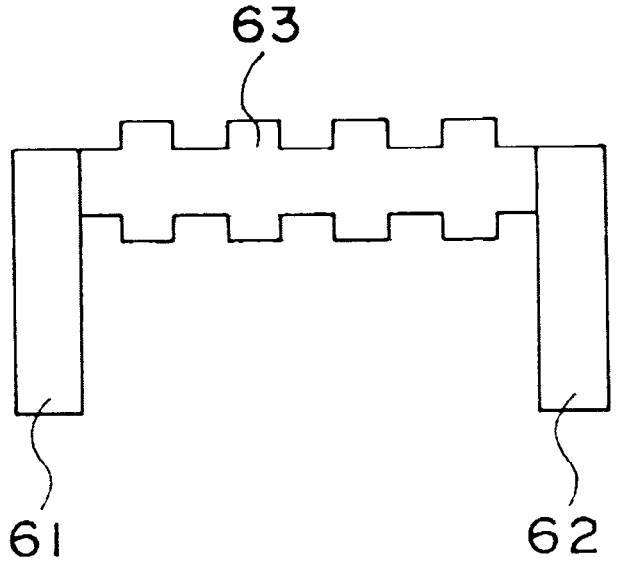
FIG. 26 (PRIOR ART)
FIG. 26 is a side view for explaining a conventional art method to increase and insulating breakdown voltage.

Japanese Patent Application Laid Open Heisei 4-280037 presents a general technique concerning an increase in an insulating breakdown voltage as shown in FIG. 26. Specifically, it teaches that the insulating breakdown voltages of electrodes 61 and 62 are improved by giving the corrugate shape to an insulating body 63 made of ceramic for supporting the electrodes 61 and 62 applied with a high voltage. Generally, to obtain such structure as presented in the Japanese Patent Application 4-280037, machining such as cutting and glading, and moulding by die are generally carried out. However, in the identified Japanese Patent Application, each portion of the device has dimensions of at least mm (millimeter) order. Accordingly, it is impossible to obtain the same structure of the field-emission cold cathode of this embodiment as that of the conventional device disclosed in the above Japanese Patent Application using the conventional manufacturing method. Because each portion of the device of this embodiment has dimension of μm order, this embodiment has a great advantage in that the structure having unevenesses can be easily obtained.

Figure 9:
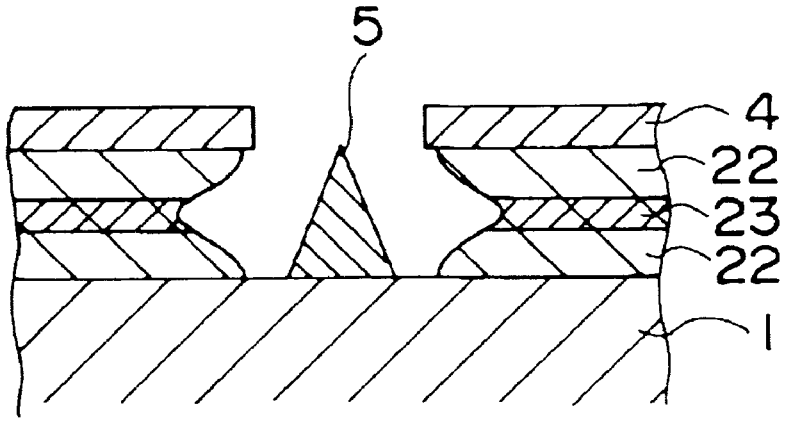
FIG. 9 is a sectional view of the field-emission cold cathode according to the fifth embodiment of the present invention.

FIGS. 8A to 8C are sectional views schematically showing a fifth embodiment of the present invention. In this embodiment, the manufacturing step for the formation of the insulating layer and the manufacturing step for the formation of the unevenesses in the insulating layer are mainly described. Other manufacturing steps of this embodiment are the same as those of the first embodiment. In the manufacturing steps of this embodiment, first a silicon oxide film of about 0.8 μm thickness serving as the insulating layer 22 is deposited on the silicon substrate 1 by means of a CVD technique using a mixed gas of monosilane ($SiH_4$) and oxygen ($O_2$). In the formation step of the silicon oxide film, a small amount of phosphine ($PH_3$) is mixed with a reaction gas while the thickness of the silicon oxide film being deposited is 0.3 μm to 0.5 μm. A phosphor silicate glass layer 23 of 0.2 μm thickness is formed at a center of the insulating layer 22. The molybdenum film of about 0.2 μm thickness serving as the gate layer is deposited on the insulating layer 22. Thereafter, the photoresist layer 6 having an opening 7 of the diameter about 1 μm is formed by means of a photolithography technique (FIG. 8A). The gate layer 4 and the insulating layer 22 are etched by means of an RIE technique using carbon tetrafluoride (FIG. 8B) Since an etching rate of the phosphor silicate glass layer 23 by means of the wet etching using hydrofluoric acid is higher than that of the normal silicon oxide film, subsequently, a section structure having the unevenness shown in FIG. 8C is formed. Thereafter, the emitter electrode 5 is formed in the same manner as the first embodiment. Thus, the field-emission cold cathode as shown in FIG. 9 is completed.

Figure 22A:
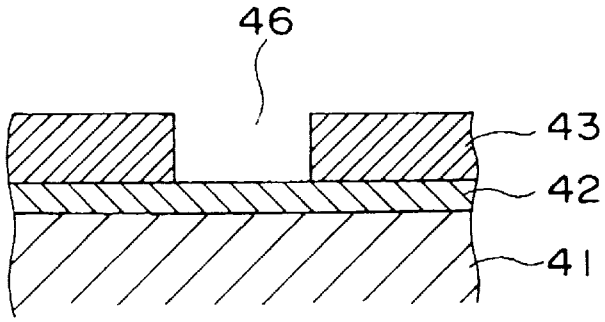
FIGS. 22A to 22D are sectional views showing manufacturing steps of the conventional field-emission cold cathode shown in FIG. 21.
Figure 22B:
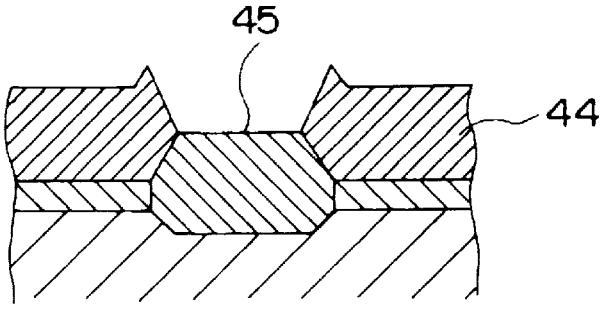
Figure 22C:
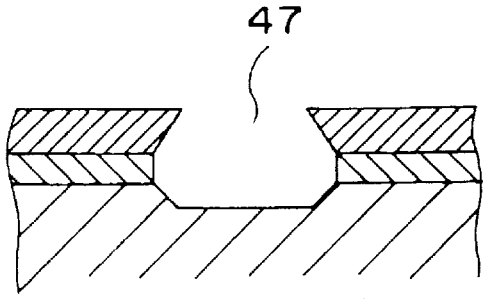
Figure 22D:
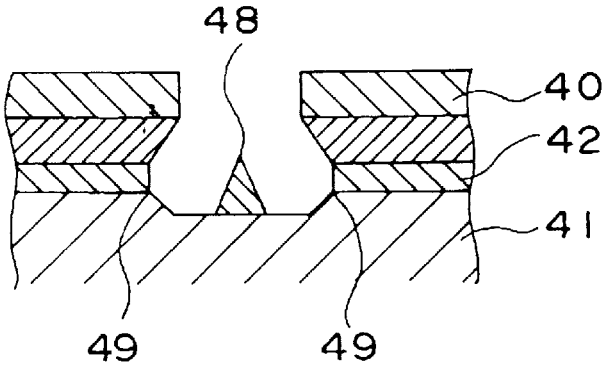
Figure 23:
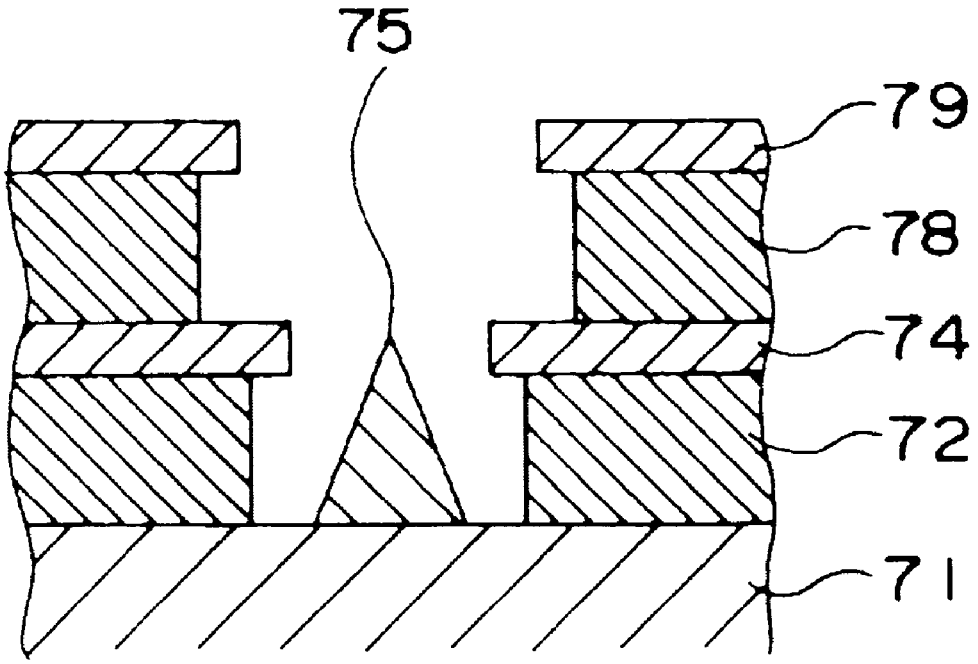
FIG. 23 (PRIOR ART)
FIG. 23 is a sectional view of a conventional field-emission cold cathode having a control electrode.
Figure 24A:
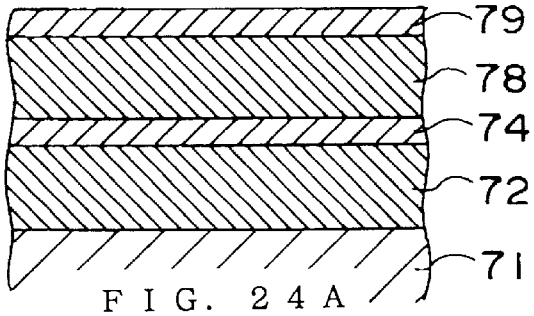
FIGS. 24A to 24D are sectional views showing manufacturing steps of the conventional field-emission cold cathode shown in FIG. 23.
Figure 24B:
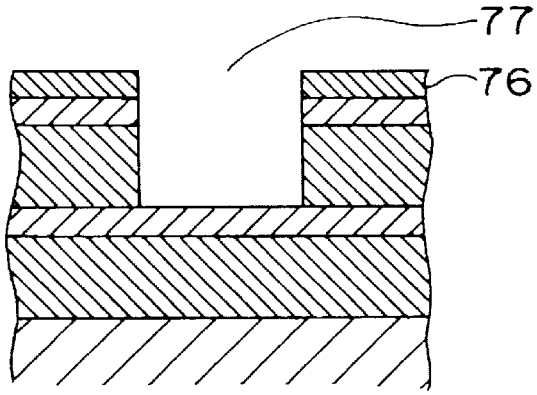
Figure 24C:
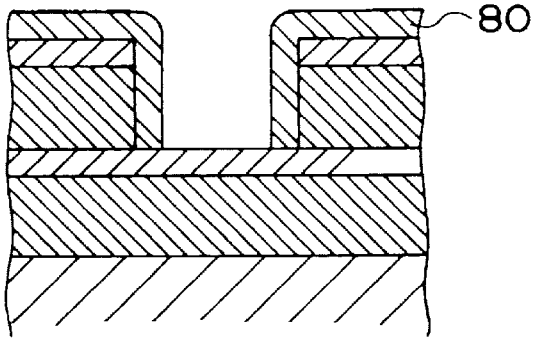
Figure 24D:
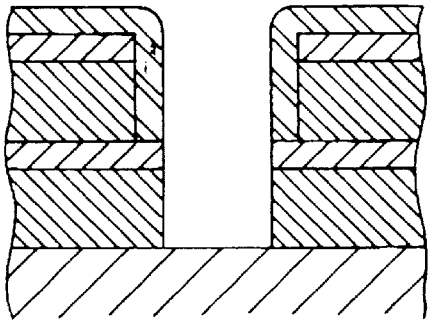

The sectional structure as shown in FIG. 22D is similar to that of this embodiment and is disclosed in Japanese Patent Application Laid Open Heisei 4-262337. The sectional structure which it discloses is different, however, from that of this embodiment in that the silicon substrate 41 is excavated. For this reason, since a circular protrusion is formed on the silicon substrate 41 at the three-point contact at which the silicon substrate 41, the oxide film 42, and the vacuum contact, the electric field is apt to concentrate at this portion. Therefore, there is a problem that an insulating breakdown voltage is decreased. Furthermore, there is no effect that the surface path of the oxide films 42 and 44 from the silicon substrate 41 to the gate layer 40 is lengthened.

Figure 27:
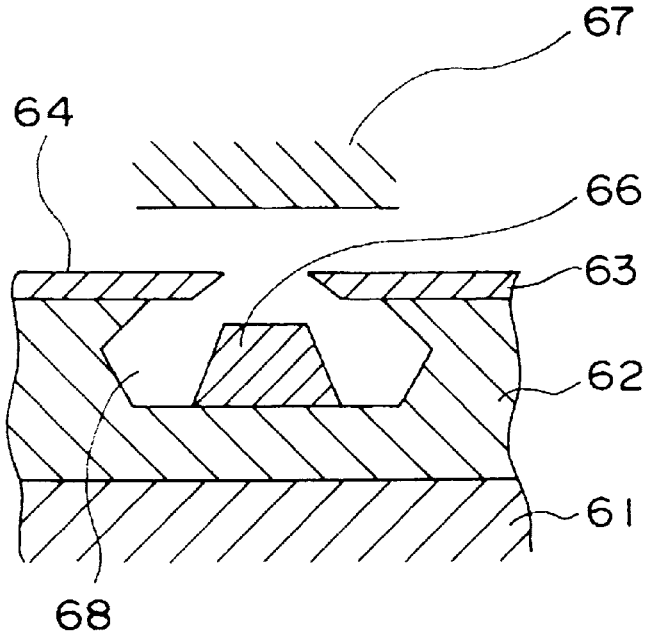
FIG. 27 (PRIOR ART)
FIG. 27 is a sectional view of a structure of an insulating layer of a conventional field-emission cold cathode.

The sectional structure as shown in FIG. 27 is disclosed in Japanese Patent Application Laid Open Heisei 3-252029. The sectional structure disclosed in Japanese Patent Application Laid Open Heisei 3-252029 is not a vertical type which is the objective of the present invention. Specifically, the field-emission cold cathode in FIG. 27 is a technique concerning a lateral type micronized cold cathode in which electrons are emitted in parallel with the surface of the substrate. Specifically, a groove 68 is formed by etching in a portion of an undoped semiconductor layer 62 between a cathode electrode 64 and an anode electrode 63 so that a surface path is lengthened. This embodiment of the present invention, though, concerns a technique for forming an unevenness in the insulating layer 22 between the silicon substrate 1 and the uppermost gate layer 4 stacked thereon as shown in FIG. 9. Therefore, the field-emission cold cathode of this embodiment shown in FIG. 9 differs from that in FIG. 27 showing the conventional device.

Figure 10:
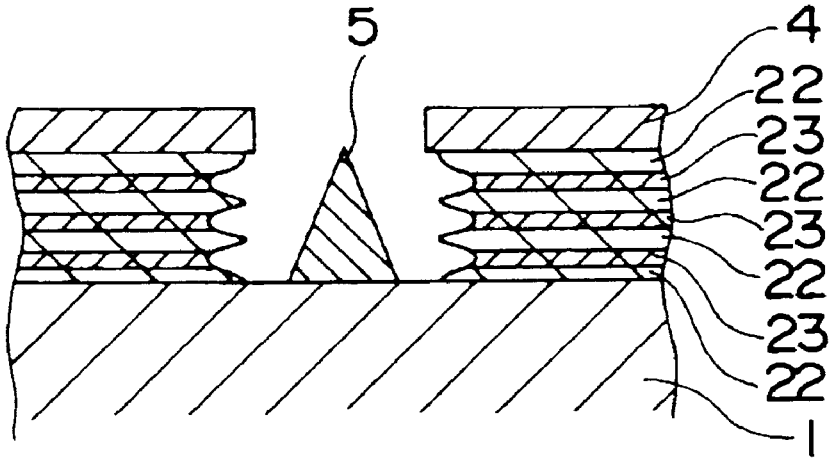
FIG. 10 is a sectional view of a modification of the field-emission cold cathode according to the fifth embodiment of the present invention.

In the present description of this embodiment, phosphine is mixed with the reaction gas only once when the insulating layer 22 is formed. However, phosphine may be mixed with the reaction gas several times. For example, when phosphine is mixed with the reacting gas three times, the sectional structure as shown in FIG. 10 can be obtained.

In the description of this embodiment, the method of how to mix phsophine with the reaction gas in the formation of the insulating layer 22 is explained. The etching rate of the silicon oxide film can be reduced by mixing diborane ($B_6H_6$)

instead of the phosphine so that a sectional structure in which an unevenness is formed can also be obtained. Furthermore, in the description of this embodiment, mixing of the gases is performed intermittently. Also in this case, since gas composition in a reaction chamber does not change rapidly, the composition of the insulation layer changes continuously. However, the composition of the insulating layer can be changed by changing the gas mixing ratio continuously so that the shape of the sectional structure can be determined according to the gas mixing ratio.

Figure 11A:
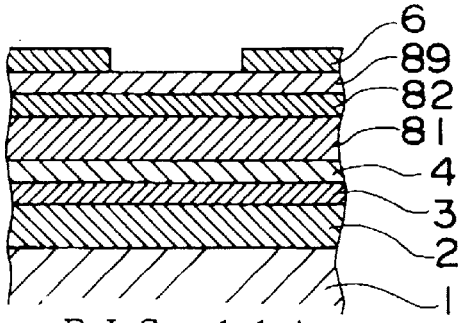
FIGS. 11A to 11E are sectional views showing manufacturing steps of a field-emission cold cathode having a control electrode according to a sixth embodiment of the present invention.
Figure 11B:
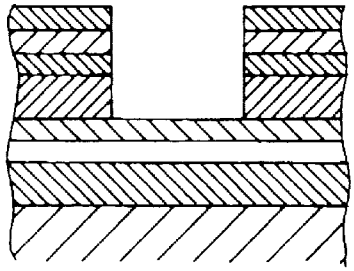

FIGS. 11A to 11E are sectional views schematically showing a sixth embodiment of the present invention. In this embodiment, first of all, the first and second insulating layers 2 and 3, and the gate layer 4 are formed on the silicon substrate 1 sequentially. These steps are the same as those of the first embodiment. Subsequently, a silicon oxide film of about 0.6 $\mu$m thickness serving as the first intermediate insulating layer 81 is formed on the gate layer 4 using the CVD technique. Next, a silicon nitride film of about 0.2 $\mu$m thickness serving as the second intermediate layer 82 is formed using the CVD technique. Furthermore, a molybdenum film of about 0.2 $\mu$m thickness serving as the control electrode layer 89 is formed thereon by a vacuum evaporation technique. Thereafter, the photoresist layer 6 having an opening with a diameter of about 1.4 $\mu$m is formed (FIG. 11A). The control electrode layer 89, the second and first intermediate layers 82 and 81 are etched by an anisotropic RIE technique using carbon tetrafluoride and using the photoresist layer 6 as a mask (FIG. 11B). After removing the photoresist layer 6, a silicon oxide film of about 0.2 $\mu$m is deposited using the CVD technique. At this time, the thickness of the portion of the silicon oxide film formed by the CVD technique, which is disposed on the gate layer 4 at the bottom of the opening, is thinner than that of other portions of the silicon oxide film.

Figure 11C:
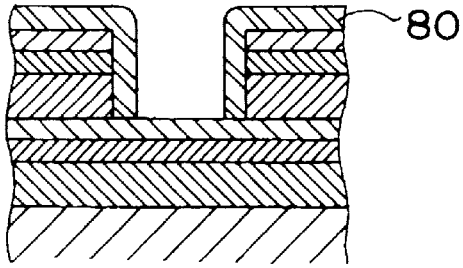
Figure 11D:
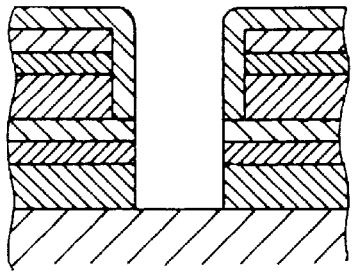
Figure 11E:
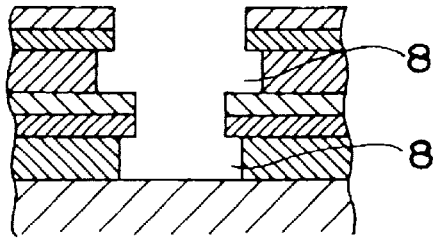
Figure 12:
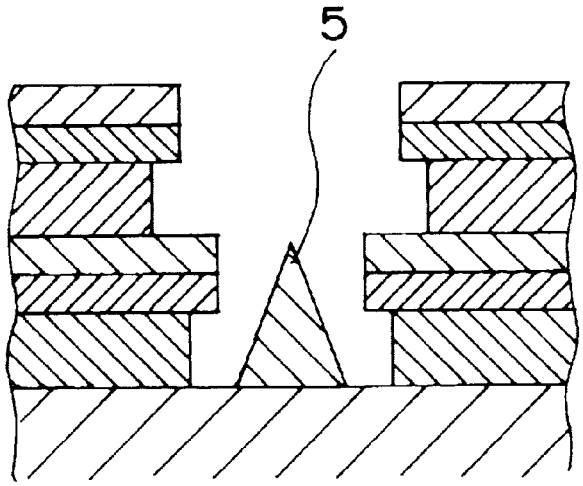
FIG. 12 is a sectional view of the field-emission cold cathode having the control electrode according to the sixth embodiment of the present invention.

Next, when the silicon oxide film is etched using the RIE technique, the silicon oxide film is made to be the shape of the side wall 80 having an opening with a diameter of about 1 $\mu$m as shown in FIG. 11C. Furthermore the gate layer 4, and the second and first insulating layers 3 and 2 are etched by means of the RIE technique sequentially using the side wall 80 as a mask. Thus, the sectional structure as shown in FIG. 11D is obtained. Subsequently, when the side wall 80, the first insulating layer 2, and the first intermediate insulating layer 81 are selectively etched, the sectional structure having the step difference 8 can be obtained as shown in FIG. 11E. Next, the emitter electrode 5 is formed in the same manner as the first embodiment, thereby completing the field-emission cold cathode as shown in FIG. 12.

Figure 28:
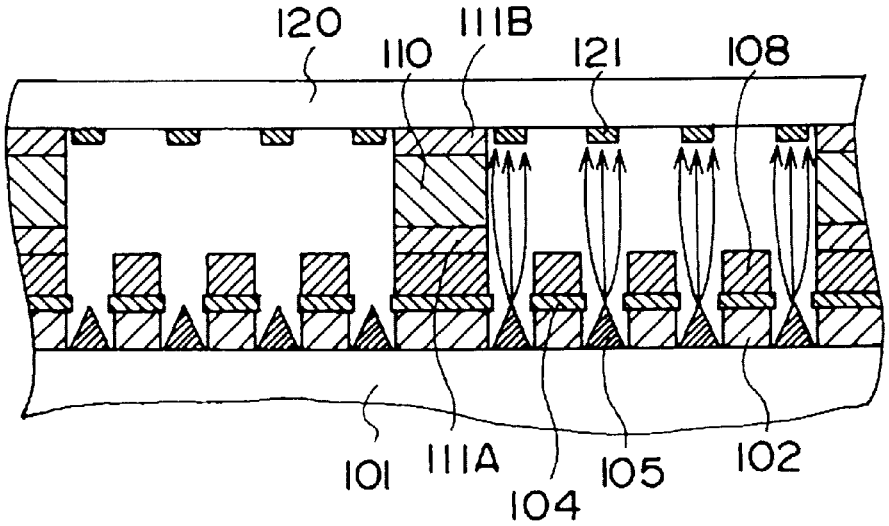
FIG. 28 (PRIOR ART)
FIG. 28 is a sectional view of a structure of a display element using the conventional field-emission cold cathode.
Figure 29:
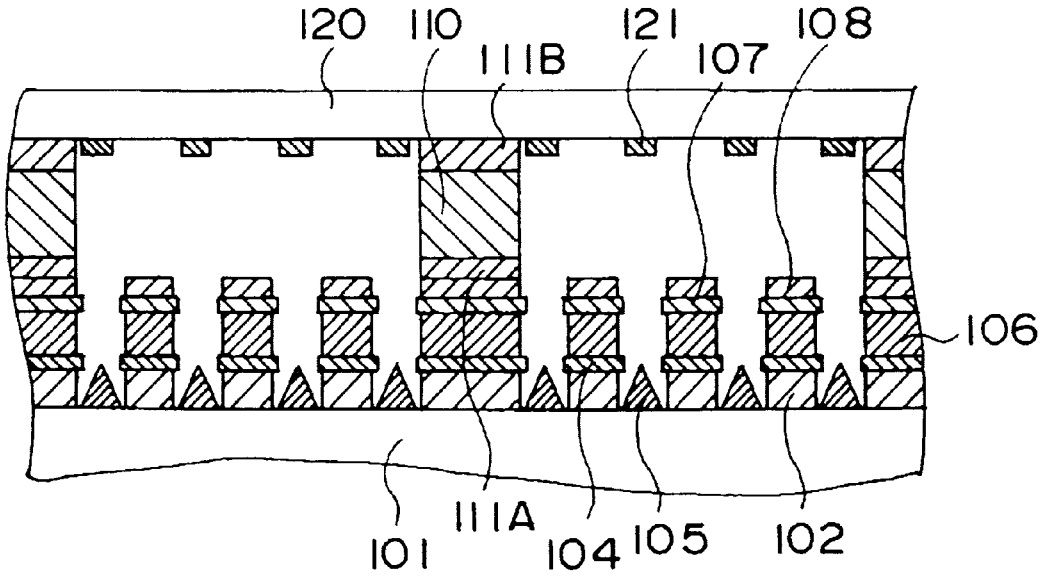
FIG. 29 (PRIOR ART)
FIG. 29 is a sectional view of a structure of a display element using the conventional field-emission cold cathode.

In Japanese Patent Application Laid Open Heisei 7-282718, as shown in FIGS. 28 and 29, a stacked structure is disclosed in which a deflection means 110 capable of applying a high voltage is stacked on the gate layer 104 or the deflection electrode 107 through the upper insulating layer 108 and the insulating layer 111A. This structure is such that the upper insulating layer 108 and the insulating layer 111A serve as two kinds of insulating layers which are interposed between either the gate layer 104 or the deflection electrode 107 and another insulating layer thereon. However, the sectional surfaces of the two kinds of the insulating layers are continuously at the same level, and there is no unevenness on this sectional surface. Furthermore, in order to obtain this sectional structure, the following steps are carried out. Specifically, the under portion in which the upper insulating layer 108 is formed on either the gate layer 104 or the deflection electrode 107, the middle portion in which the insulating layers 111A and 111B are formed on both surfaces of the deflection means 110 made of a metal plate and then an opening portion is formed by punching or etching, and the upper portion in which a conductive film (not shown) and the fluorescent film 121 are formed on the glass substrate 120, are prepared separately. Thereafter, these are attached to each other.

In this embodiment, a plurality of insulating layers are piled up and the sectional structure without an unevenness is formed. Thereafter, the sectional structure with the unevenness can be obtained utilizing the difference of the etching properties of the respective insulating layers. Therefore, the sectional structure with the unevenness can be obtained with a very high precision.

On the other hand, in the conventional field-emission cold cathode disclosed in Japanese Patent Application Laid Open Heisei 7-282718, the two insulating layers are simply stacked, and therefore the unevenesses are not formed in a reproducible manner on the section structure of the two insulating layers and the distance between the surfaces of the sectional structure constituted by the two insulating layers is not lengthened. Furthermore, in the conventional field-emission cold cathode disclosed in Japanese Patent Application Laid Open Heisei 7-282718, the three components manufactured separately are attached after positioning, and the interface between the upper insulating layer 108 and the insulating layer 111A is one of the attaching surfaces. Though the formation of unevenesses is tried using the above described conventional method, it is actually impossible to form the unevenesses to the required working precision and positioning precision. Furthermore, it is apparently impossible to form other electrodes in the opening portions corresponding to all emitter electrodes 105 through the insulating layers with the uneven surface section.

From the above description, it is apparent that the above prior art is different from the present invention.

Figure 13:
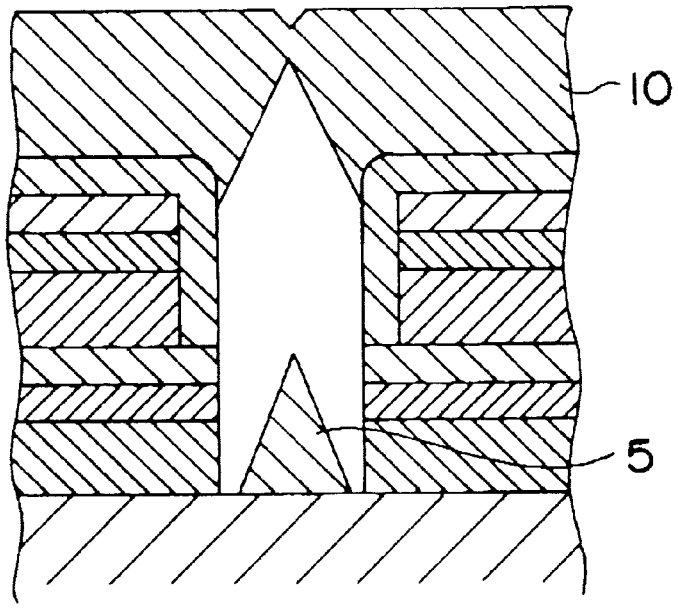
FIG. 13 is a sectional view showing one of manufacturing steps of a field-emission cold cathode having a control electrode according to a seventh embodiment of the present invention.

FIG. 13 is a sectional view schematically showing manufacturing steps of a seventh embodiment of the present invention. In this embodiment, steps in FIGS. 11A to 11D are the same as those of the sixth embodiment. In this embodiment, molybdenum is evaporated under a vacuum from the front of the substrate so that the emitter electrode 5 is formed (FIG. 13). Finally, when the side wall 80, the first insulating layer 2, and the first intermediate insulating layer 8 are etched, the field-emission cold cathode shown in FIG. 12 is completed. In this embodiment, since the molybdenum film 10 deposited on the control electrode layer 89 is removed by etching the side wall 80, a special sacrifice layer need not be provided. Furthermore, a part of the molybdenum turns to the side of the opening when the emitter electrode 5 is formed by evaporating and the molybdenum film is formed on the side of the opening. Hence, the molybdenum film is deposited on the side wall 80. Since the molybdenum film is removed when an etching is performed, there is no possibility of a deterioration of the insulation characteristic between the gate layer 4 and the control electrode 89. Furthermore, in the same manner as the second embodiment, the same effect can be obtained by composing the insulating layer using other materials.

Figure 14A:
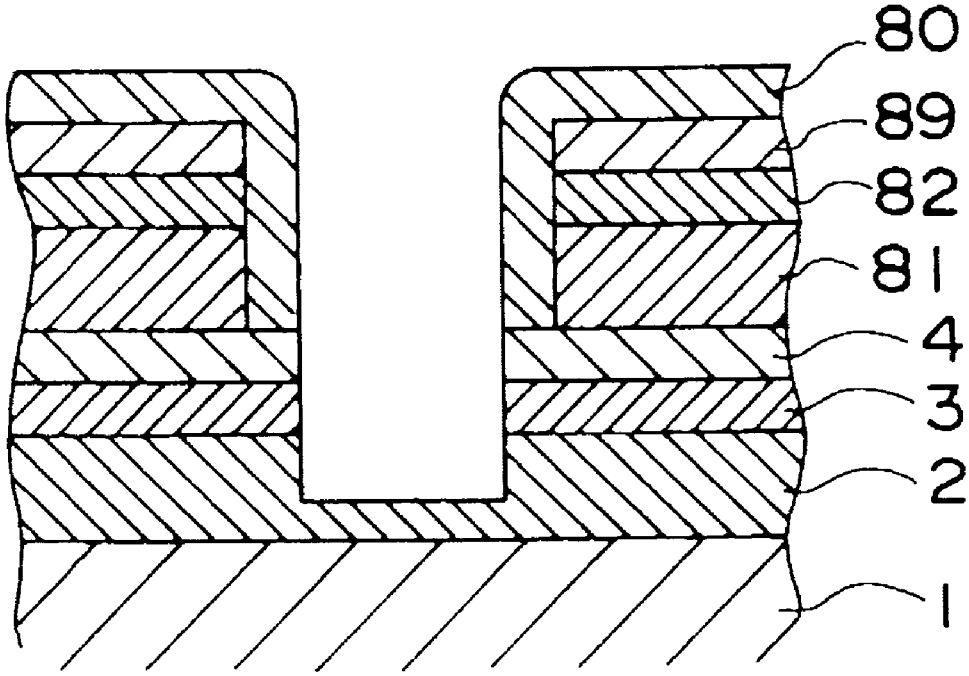
FIGS. 14A to 14B are sectional views showing manufacturing steps of a field-emission cold cathode having a control electrode according to an eighth embodiment of the present invention.
Figure 14B:
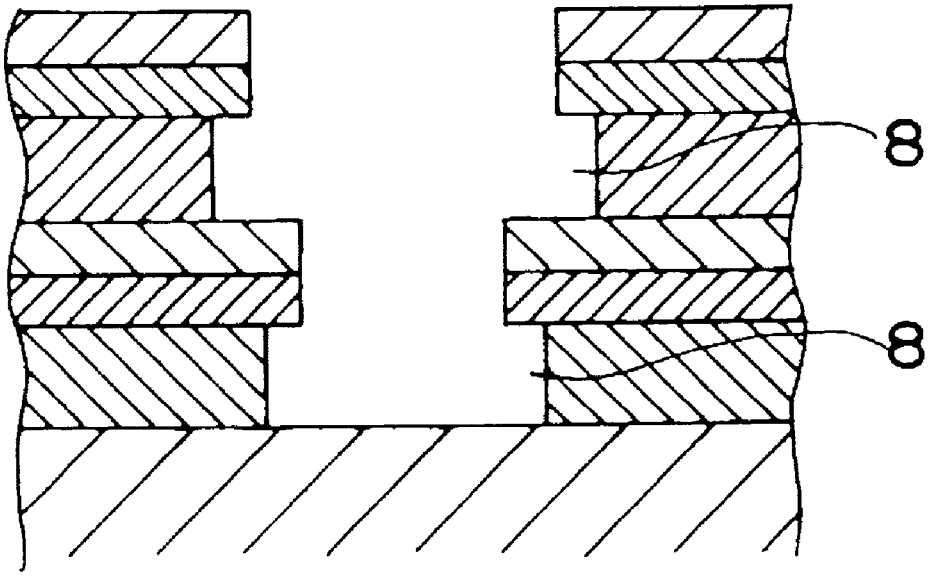

FIGS. 14A and 14B are a sectional view schematically showing a manufacturing method of an eighth embodiment. In figures, steps for forming step differences in insulating layers are shown, and other steps are the same as those of the sixth embodiment. In this embodiment, the etching of the first insulating layer 2 by means of an RIE technique is stopped immediately before completion of the etching of the first insulating layer 2 (FIG. 14A). Subsequently, the side wall 80, the first insulating layer 2, and the intermediate insulating layer 81 are etched using hydrofluoric acid so that the silicon substrate 1 is exposed and the step differences are formed (FIG. 14B). According to this embodiment, the silicon substrate 1 is never over-etched when the first insulating layer 2 is etched by means of the RIE technique. Therefore, a protrusion is not left on the silicon substrate 1. Furthermore, there is a benefit of a margin for the end point of the RIE etching.

Figure 15A:
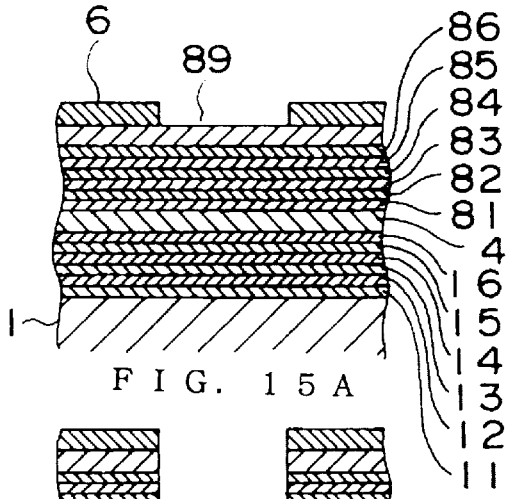
FIGS. 15A to 15E are sectional views showing manufacturing steps of a field-emission cold cathode having a control electrode according to a ninth embodiment of the present invention.
Figure 15B:
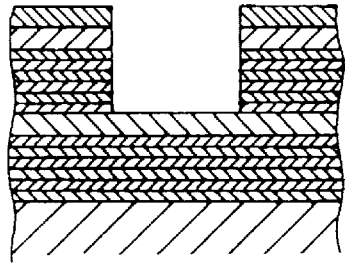
Figure 15C:
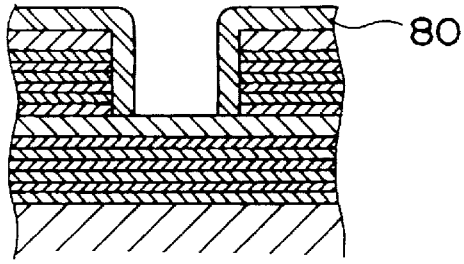
Figure 15D:
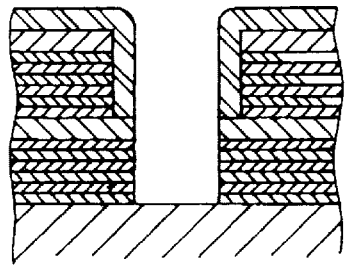
Figure 15E:
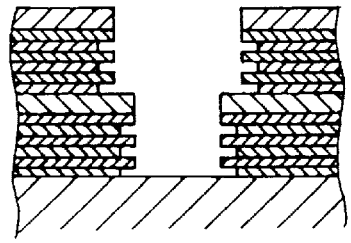
Figure 16:
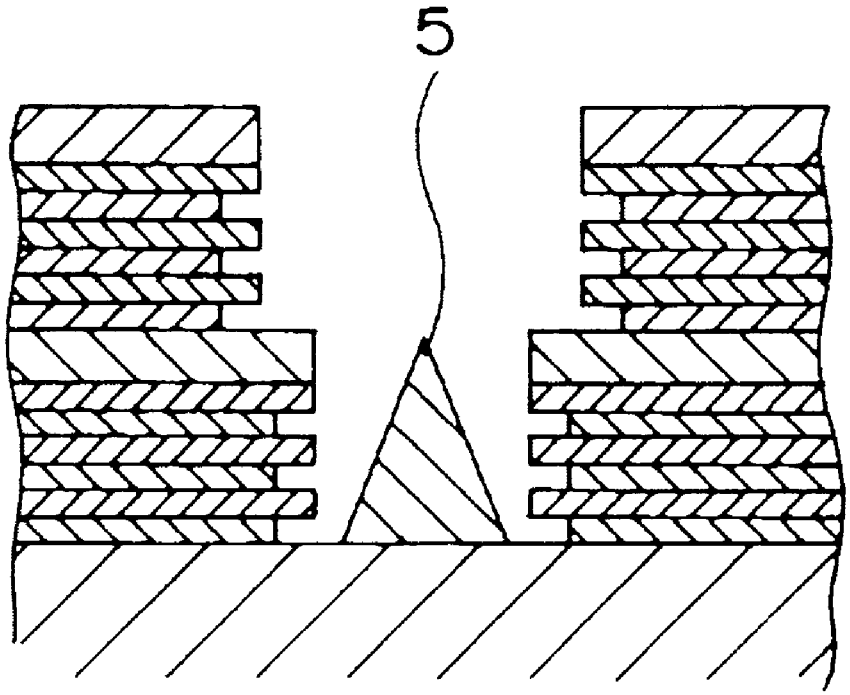
FIG. 16 is a sectional view of the modification of the field-emission cold cathode having the control electrode according to the ninth embodiment of the present invention.

FIGS. 15A to 15E are sectional views schematically showing manufacturing steps of a ninth embodiment of the present invention. In the description of this embodiment, steps for forming the insulating layer and step differences in the insulating layer are mainly described. Other steps in this embodiment are the same as those of the sixth embodiment. In this embodiment, first of all, a silicon oxide film serving of about 0.13 μm thickness as the first insulating layer 11 is deposited on the silicon substrate 1. Subsequently, a silicon nitride film of about 0.13 μm thickness serving as the second insulating layer 12 is deposited on the first insulating layer 11. Further, silicon oxide films and silicon nitride films serving as the third to sixth insulating layers 13 to 16 are deposited in a similar way. A molybdenum film of about 0.2 μm thickness serving as the gate layer 4 is deposited thereon. Further, silicon oxide films and silicon nitride films serving as the first to sixth intermediate insulating layers 81 to 86 are deposited thereon in a similar way. A molybdenum film of about 0.2 μm thickness serving as the control electrode layer 89 is deposited thereon. Thereafter, the photoresist layer 6 having an opening with a diameter of about 1.4 μm is formed by means of photolithography (FIG. 15A). The control electrode layer 89, and the sixth to first intermediate insulating layers 86 to 81 are etched by means of the RIE technique using carbon tetrafluoride, which uses the photoresist layer 6 as a mask (FIG. 15B). After the photoresist layer 6 is removed, a silicon oxide film of about 0.2 μm thickness is deposited using the CVD technique. At this time, the thickness of the portion of the silicon oxide film which corresponds to the gate layer 5 facing the opening is thinner than that of other portions of the silicon oxide film. Subsequently, after the silicon oxide film is etched by means of the RIE technique, the side wall 80 having an opening with a diameter of about 1 μm is obtained as shown in FIG. 15C. Furthermore, the gate layer 4 and the sixth to first insulating layers 16 to 11 are etched by means of the RIE technique using the side wall 80 as a mask, and the sectional structure shown in FIG. 15D is obtained. Subsequently, after the side wall 80, the first, third, and fifth insulating layers 11, 13, and 15, and the first, third, and fifth intermediate insulating layers 81, 83, and 85 are selectively etched, the sectional structure having the shape as shown in FIG. 15E can be obtained. Next, the field-emission cold cathode shown in FIG. 16 is completed by forming the emitter electrode in a manner similar to the first embodiment.

Also in this embodiment, in the same manner as the second embodiment, it is possible to adopt the method that the cone is formed in a state in which the side wall 80 is present shown in FIG. 15D, and then the silicon oxide layer is etched. Furthermore, as in the eighth embodiment, it is possible to adopt the method that the etching of the first insulating layer 11 by means of the RIE technique is stopped immediately before the first insulating layer 11 is completely etched, and then the wet etching of the first insulating layer using hydrofluoric acid is performed to form unevenesses as well as to expose the silicon substrate.

Figure 17A:
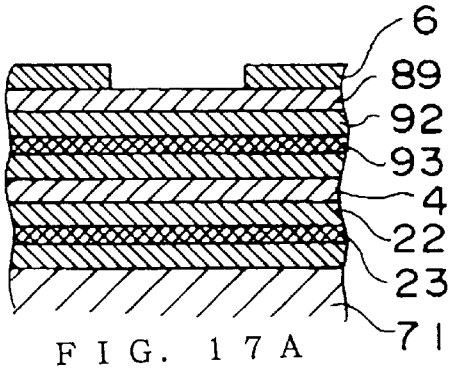
FIGS. 17A to 17E are sectional views showing manufacturing steps of a field-emission cold cathode having a control electrode according to a tenth embodiment of the present invention.
Figure 17B:
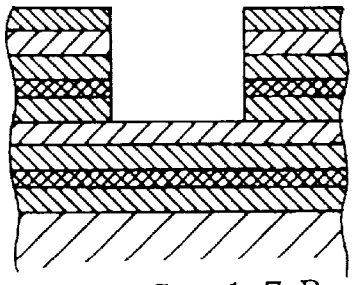
Figure 17C:
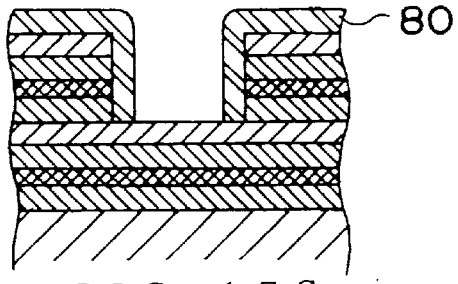
Figure 17D:
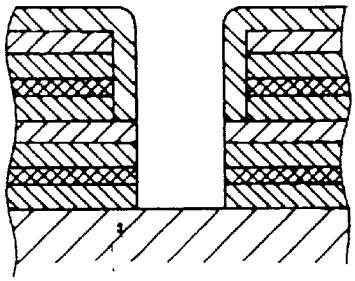
Figure 17E:
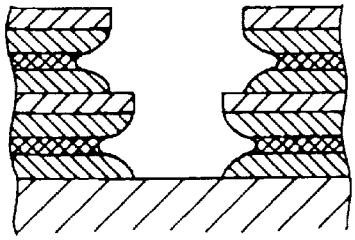
Figure 18:
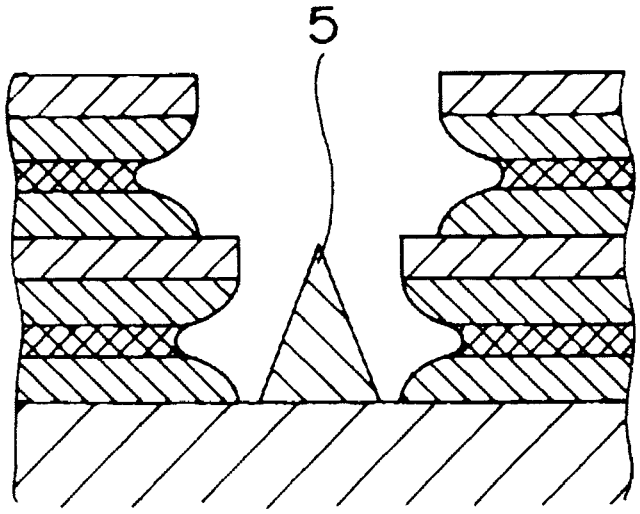
FIG. 18 is a sectional view of the field-emission cold cathode having the control electrode according to the tenth embodiment of the present invention.

FIGS. 17A to 17E are sectional views schematically showing manufacturing steps of a tenth embodiment of the present invention. In the description of the tenth embodiment, steps for forming the insulating layer and steps for forming unevenesses are mainly described. Other steps are the same as those of the sixth embodiment. First of all, the first silicon oxide film 22 of about 0.8 μm thickness is formed on the silicon substrate 1, and a molybdenum film of about 0.2 μm thickness serving as the gate layer 4 is formed. The second silicon oxide film 92 of about 0.8 μm thickness is deposited thereon, and a molybdenum film of about 0.2 μm thickness serving as the control electrode layer is deposited. At this time, the first and second silicon oxide films 22 and 92 are grown by means of the CVD technique using a mixed gas of mono-silane ($S_iH_4$) and oxygen ($O_2$). Furthermore, in the respective steps of the first and second silicon oxide films, while the thicknesses of the films are 0.3 to 0.5 μm, a small amount of phosphine ($PH_3$) is mixed with a reaction gas. Thus, the first and second phosphor silicate glass layers 23 and 93 of 0.2 μm thickness are formed at the centers of the respective silicon oxide films 22 and 92. Thereafter, the photoresist layer 6 having an opening with a diameter of about 1.4 μm is formed by means of a photolithography technique (FIG. 17A). The control electrode layer 89 and the second silicon oxide film 92 are etched by means of the RIE technique using carbon tetrafluoride and the like and using the photoresist layer 6 as a mask (FIG. 17B). After the photoresist layer 6 is removed, a silicon oxide film of about 0.2 μm thickness is deposited. Next, the silicon oxide film is etched by means of the RIE technique so that the side wall having an opening with a diameter of about 1 μm is formed (FIG. 17C). The gate layer 4 and the first silicon oxide film 22 are etched by means of the RIE technique using the side wall as a mask (FIG. 17D). Subsequently, the side wall 80 and the first and second silicon oxide films 22 and 92 are wet-etched using hydrofluoric acid. Since the etching rate of the phosphor silicate glass is higher than that of an ordinary silicon oxide film, the section structure having the unevenesses as shown in FIG. 17E is formed. Thereafter, after the emitter electrode is formed in the same manner as the first embodiment, the field-emission cold cathode as shown in FIG. 18 is completed.

Figure 19:
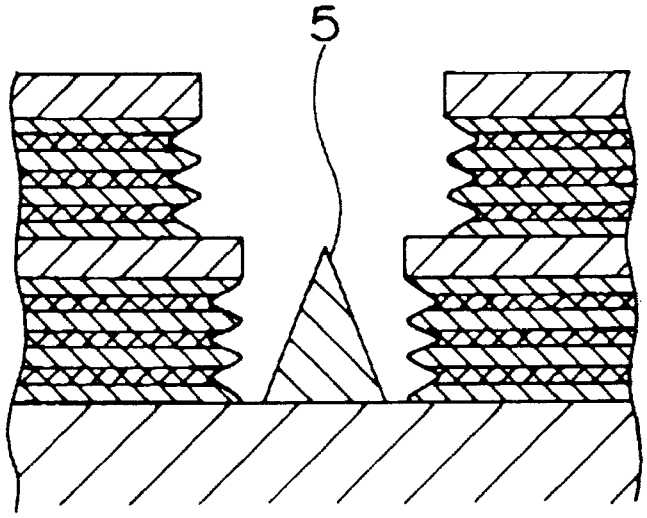
FIG. 19 is a sectional view of a modification of the field-emission cold cathode having the control electrode according to the tenth embodiment of the present invention.
Figure 20A:
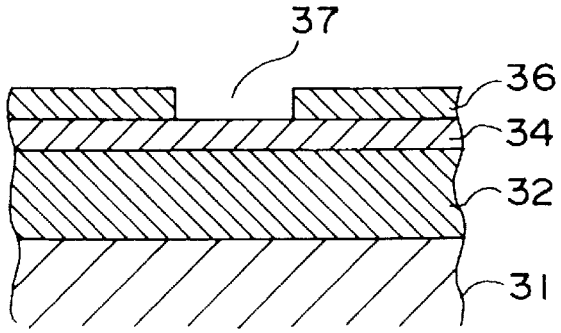
FIGS. 20A to 20D are sectional views showing manufacturing steps of a conventional field-emission cold cathode.
Figure 20B:
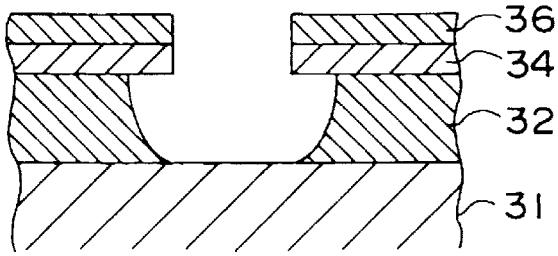
Figure 20C:
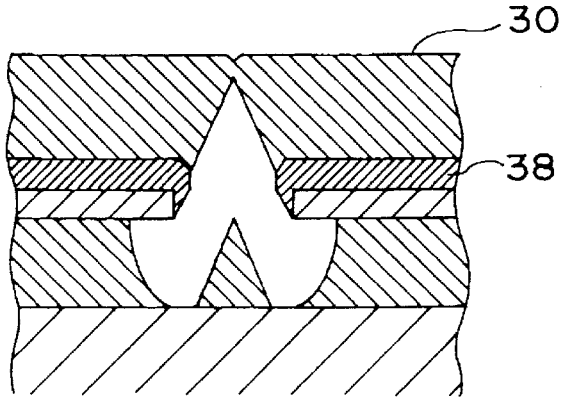
Figure 20D:
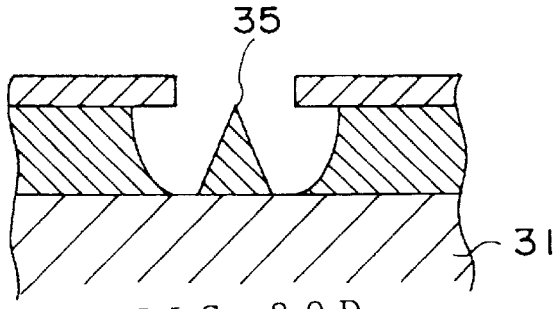
Figure 21:
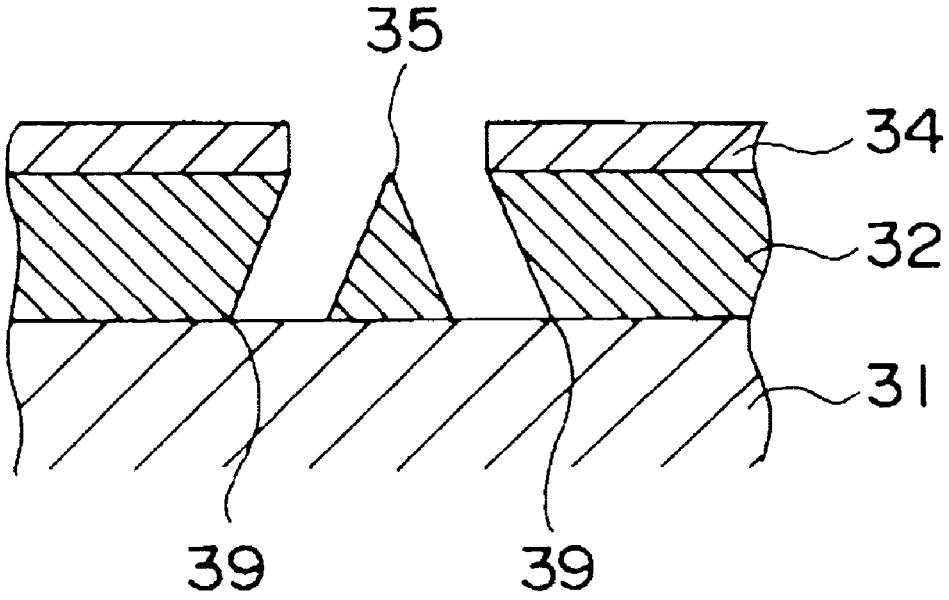
FIG. 21 (PRIOR ART)
FIG. 21 is a sectional view of the conventional field-emission cold cathode.

In this embodiment, during the formation of the first and second silicon oxide films 22 and 92, phosphine is once mixed with the reaction gas. However, it is possible to mix phosphine with the reaction gas a plurality of times. When the mixing operation is performed three times, the section structure as shown in FIG. 19 can be obtained.

In the description of this embodiment, the method in which phosphine is mixed with the reaction gas during the formation of the first and second silicon oxide films 22 and 92 is described. If diborane ($B_2H_6$) is mixed instead of phosphine for the formation of the silicon oxide films, the etching rate of the silicon oxide can be reduced as described in the fifth embodiment in which the insulating film is formed using diborane ($B_2H_6$). Thus, the unevenesses can be formed in the sectional structure.

In the descriptions of the sixth to tenth embodiments, the methods are described in which the lower and upper aggregations of the insulating layers having the same layer constitution, positioned under and on the gate layer 4, and the unevenesses are formed in the lower and upper aggregations. The unevenesses may be formed in one of the lower and upper aggregations, and the aggregation without the unevenesses may be composed of a single layer. Furthermore, when the unevenesses are formed in both of the layer aggregations, the lower and upper aggregations may have different combinations of films. For example, the upper aggregation may be formed by changing the gas composition using the CVD technique, and the lower aggregation may be formed by piling an oxide film on a nitride film, and vice versa.

In the description of the sixth to tenth embodiments, the control electrode layer formed over the gate layer 4 is a single layer. When the structure is made in which a plurality of control electrode layers, for example, the second, third, and fourth, . . . , control electrode layers, are piled up interposing the intermediate insulating layers between the adjacent control electrode layers, it is possible to make the sections of the respective intermediate insulating layers uneven.

The insulating layer is disposed at the position to support the gate layer so that the mechanical strength of the device can be maintained at a predetermined high level. The end portions of the insulating layers are made uneven so that a leakage path formed by the end portions of the insulating layers is lengthened and, in addition, is discontinuous to the direction of an electric field. Thus, a reduction in the leakage current and an increase in the breakdown voltage can be achieved. Furthermore, the triple junction corresponding to an electron emitting point for the leakage current is disposed at the position which can not be seen from the outside of the gate opening portion. Therefore, evaporation particles during the cone-shaped emitter electrode formation, dust entering after completion of the element, and splashes entering from the adjacent broken element never attach to the vicinity of the triple junction. Therefore, a protrusion due to the particle attachment is not formed. Accordingly, a useless electric field concentration never occurs and chain break down of the adjacent element can be prevented. Thus, a high yield can be achieved and a stable operation field-emission cold cathode can be provided.

While the present invention and its advantages have been described in conjunction with preferred embodiments in the above detailed description, the invention is not limited thereto, but, as can be seen by one of ordinary skill, various modifications are possible within the scope and spirit of the appended claims.

What is claimed is:

1. In a field-emission cold cathode which comprises a substrate, as least one surface of the substrate being conductive, an insulating layer aggregation and a conductive gate layer formed on said conductive surface of substrate, and an emitter electrode disposed in a cavity formed in said insulating layer and said conductive gate layer, an improvement comprising:

said insulating layer aggregation being composed of at least two piled-up insulating layers, wherein a wall surface is formed by end portions of said insulating layers and said gate layer, said wall surface forming said cavity with a section structure such that one end portion of at least one of said insulating layers other than an insulating layer closest to said gate layer is indented, and wherein an opening defined by surfaces of said wall surface formed by end portions of an insulating layer of said insulating layers closest to said gate layer has a diameter Di, and an opening defined by a surface of said wall surface formed by end portions of said gate layer has a diameter Dg, and Di and Dg have relative sizes such that $-Dg/2<Dg-Di<Dg/3$.

2. The field-emission cold cathode according to claim 1, wherein the composition of at least one of said insulating layers varies continuously along a thickness direction.

3. The field-emission cold cathode according to claim 1, wherein a triple junction formed of an exposed portion of said substrate, an exposed end portion of said insulating layer aggregation, and a space contacting one another is disposed at a position not visible from a direction normal to said exposed portion of said substrate, said exposed portion of said substrate facing said cavity and said emitter electrode being on said exposed portion of said substrate.

4. The field-emission cold cathode according to claim 3, wherein said exposed portion of said substrate is at the same level as the interface between said insulating layer aggregation and said substrate.

5. The field-emission cold cathode according to claim 1, wherein said insulating layer closest to said gate layer is made of silicon nitride, and said indented insulating layer is made of silicon oxide.

6. The field-emission cold cathode according to claim 1, comprising an intermediate insulating layer and conductive control electrode layer deposited on said gate layer, and said intermediate layer is composed of at least two films formed of different materials.

7. A field-emission cold cathode, comprising:

a substrate, at least one surface of said substrate being conductive;

an approximately cone-shaped emitter electrode formed on said conductive surface of said substrate, said emitter electrode being made of a material different from that of said conductive surface;

a first insulating layer formed on said conductive surface of said substrate, said first insulating layer having a first opening larger than a bottom area of said emitter electrode to be spaced apart from said emitter electrode so as to expose said conductive surface therebetween;

a second insulating layer formed on said first insulating layer and having a second opening coaxially aligned with said first opening, a size of said second opening being smaller than said first opening; and a gate electrode layer formed on said second insulating layer and having a third opening coaxially aligned with said second opening, said gate electrode layer having substantially uniform thickness around said third opening so as to have a vertical side wall in said third opening, and an expression $-Dg/2<Dg-Di<Dg/3$ being satisfied, in which Dg is the diameter of said third opening, and Di is the diameter of said second opening of said gate layer.

* * * * *